US006165030A

United States Patent [19]

Lewis

[11] Patent Number: 6,165,030

[45] Date of Patent: Dec. 26, 2000

[54] PEDAL DRIVEN PROPULSION DEVICE

[76] Inventor: Robert M. Lewis, 24 Mulholland Dr., Ipswich, Mass. 01938

[21] Appl. No.: 09/558,264

[22] Filed: Apr. 25, 2000

[51] Int. Cl.[7] ..... B63H 16/20

[52] U.S. Cl. ..... 440/30; 440/31

[58] Field of Search ..... 440/21, 26, 27–31

[56] References Cited

U.S. PATENT DOCUMENTS

| | | | |
|---|---|---|---|
| 2,612,859 | 10/1952 | Billman et al. | 440/31 |
| 2,956,535 | 10/1960 | Hunt . | |
| 3,244,136 | 4/1966 | Yarborough | 440/31 |
| 3,377,976 | 4/1968 | Gustine | 440/28 |
| 3,987,749 | 10/1976 | Anderson . | |
| 4,324,551 | 4/1982 | Gurries | 440/28 |
| 4,427,392 | 1/1984 | Schneider | 440/30 |
| 4,676,755 | 6/1987 | Yagan | 440/26 |
| 4,891,024 | 1/1990 | Benjamin | 440/28 |
| 4,943,251 | 7/1990 | Lerach et al. | 440/28 |
| 5,030,145 | 7/1991 | Chase | 440/26 |
| 5,282,762 | 2/1994 | Cerreto | 440/30 |

FOREIGN PATENT DOCUMENTS

| | | | |
|---|---|---|---|
| 805245 | 5/1951 | Germany | 440/27 |

*Primary Examiner*—Jesus D. Sotelo
*Attorney, Agent, or Firm*—Joseph R. Birkner

[57] ABSTRACT

A pedal driven propulsion device in the form of an outboard motor for a watercraft, such as a canoe is disclosed. The pedal driven propulsion device having a drive assembly and a propeller assembly with an upper portion and a lower portion. A steering assembly, for steering the watercraft, is coupled to the drive assembly at the upper portion and to a propeller rotatively disposed at the lower portion for providing propulsion to the watercraft when the drive assembly is activated by a human. A mounting assembly for mounting between the gunwales of the watercraft is provided. The lower portion and the upper portion of the propeller assembly have a bevel gear system with a bearing arrangement. The lower and upper portions are cooperatively and driveably engaged with each other by a propeller drive rod. A tilting mechanism is provided to allow the propeller assembly to be tilted. The pedal driven propulsion device is removably and adjustably mountable between the gunwales of the canoe and is portable and is readily disassembled for transporting and storage.

33 Claims, 6 Drawing Sheets

PEDAL DRIVEN PROPULSION DEVICE

FIELD OF THE INVENTION

This invention relates generally to a pedal driven propulsion device for watercraft. More particularly, the present invention relates to a human powered outboard motor having a drive assembly, a propeller assembly with an upper portion and a lower portion, a steering assembly for propelling and for steering a boat such as a canoe and a mounting assembly for mounting between the gunwales of the canoe.

BACKGROUND OF THE INVENTION

It was recognized by the present inventor that there is a need for an improved human powered propulsion device for a small boat, particularly a pedal driven outboard motor that is readily removably mountable to a canoe.

Various known types of human powered propulsion devices for water craft include those which are attachable to the transom of a boat and are pedal driven or operated by hand. Several devices employ various linkages, steering devices, drives and shaft mechanisms to accomplish the task of propelling a watercraft such as a small boat or canoe. Many of such devices rely on complicated mechanisms and cumbersome shafts and structures which interfere with operator comfort while others require that the hull of a boat be penetrated to accommodate such devices. Such known propulsion devices are inconvenient and dangerous to use. Many human powered propulsion are unsuitable for removably mounting on the gunwales of a canoe, for example. Others are not portable and are not readily disassembled for transporting or for storage.

U.S. Pat. No. 4,891,024 to Benjamin, shows a pedal boat propulsion system attachable to the transom of a boat with a pedal crank assembly having communicating shafts and U.S. Pat. No. 4,943,251 to Lerach et al shows a pedal operated drive system for a canoe with a series of rods and drive shafts with a pedal crank assembly disposed in a manner similar to Benjamin. A disadvantage of the inventions disclosed by both Benjamin and Lerach et al is that they both have long shafts located within the hull of the craft extending longitudinally from stern to bow which consumes valuable interior space for occupants or equipment.

U.S. Pat. No. 5,030,145 to Chase shows a manually operable boat propeller which operates via a hand operated single handle for driving, steering and tilting the removably mountable unit and U.S. Pat. No. 2,956,535 to Hunt discloses a manual single handle propelling and steering apparatus for small boats using a bicycle-like sprocket and chain arrangement for operation. A major disadvantage of the inventions of both Chase nor Hunt is that using the hands for propulsion is inconvenient, for example, during fishing or when eating or drinking and is very fatiguing. Furthermore, the devices of both Chase and Hunt could not be used on the gunwales of a canoe.

U.S. Pat. No. 4,676,755 to Yagan shows a removably attachable pedal driven device with a flexible drive shaft for a canoe and for a surfboard. A disadvantage of this invention is that it is not readily adaptable to any canoe without extensive modification such as by cutting a hole in the hull of the canoe for accommodating the flexible drive shaft and later, plugging the hole with a hatch. This design is undesirable due to the danger of the potential for water leakage.

U.S. Pat. No. 4,427,392 to Schneider shows an outboard propeller drive and steering assembly for a boat with a bicycle-type driving system. A disadvantage of the device of Schneider is that valuable interior space for occupants or equipment is reduced due to the interior placement of the propulsion mechanisms within the hull of the boat.

U.S. Pat. No. 4,324,551 to Gurries shows a bow mounted propeller driven boat with foot actuated pedals for maneuvering and is powered by operating the hand cranks. A disadvantage of this device is that the hands must be used to power and propel the boat which could be very difficult especially in adverse conditions or in a relatively swift current. Also, relying also upon the feet to maneuver the boat can further contribute to operator fatigue. The device is not suited for removably mounting on the gunwales of the boat.

U.S. Pat. No. 3,987,749 to Anderson shows a pedal operated propulsion unit for a small boat. The disadvantage of this design is as previously mentioned, in that the hull of the boat must be penetrated for installation thereby subjecting it to the danger of the potential for water leakage.

U.S. Pat. No. 5,282,762 to Cerreto shows a complicated mechanism for a pedal operated water craft.

Accordingly, it becomes clear that there is a great need for a pedal driven propulsion device for watercraft such as a human powered outboard motor device with a drive linkage and a steering assembly for propelling and for steering a boat such as a canoe which overcomes the disadvantages of the prior art human powered propulsion devices. Such a propulsion device should be one that is easy to use, is readily removably mountable on a canoe with no structural modifications, is fun and healthful to use and is economically manufactured.

SUMMARY OF THE INVENTION

It is therefore an object of this invention to provide a pedal driven propulsion device which avoids the aforementioned problems of prior art devices.

It is therefore an object of the present invention to provide a pedal driven propulsion device in the form of an outboard motor for a watercraft having a drive assembly, a propeller assembly with an upper portion and a lower portion, a steering assembly, for steering the watercraft, coupled to the drive assembly at the upper portion and to a propeller rotatively disposed at the lower portion for providing propulsion to the watercraft when the drive assembly is activated by a human and a mounting assembly for mounting between the gunwales of the watercraft.

It is also an object of this invention to provide a pedal driven propulsion device with the lower portion and the upper portion of the propeller assembly having a bevel gear system with a bearing arrangement.

It is a further object of this invention to provide a pedal driven propulsion device which is removably and adjustably mountable between the gunwales of a canoe.

It is also an object of this invention to provide a propulsion device that is portable and is readily disassembled for transporting and storage.

Another object of this invention to provide a pedal driven propulsion device that is propelled by a human.

It is also an object of this invention to provide a propulsion device that constructed from corrosion resistant materials.

Yet another object of the present invention is to provide a pedal driven propulsion device having a tilting mechanism for tilting the propeller assembly.

Still another object of the present invention is to provide a pedal driven propulsion device which has the upper portion and the lower portion of the propeller assembly removably joined.

It is also an object of this invention to provide a propulsion device with the upper portion having a first means for retaining the upper portion and the lower portion when the upper and the lower portions are removably joined.

It is also an object of this invention to provide a propulsion device with the upper portion having the first means for retainably supporting a fourth bearing and a third bevel gear when a propeller drive rod is removed from the third bevel gear when the upper portion and the lower portion are separated.

It is also an object of this invention to provide a propulsion device with the upper portion further having a second means for retaining the upper portion and the lower portion in relative close proximity to each other during disassembly and separation to prevent loss of the portions during transporting and storage of the propulsion device.

It is a further object of this invention to provide a pedal driven propulsion device that is simple in design, simple to manufacture, low in cost and easy and fun to use.

This invention results from the realization that there is a great need for an improved pedal driven propulsion device, particularly a pedal driven propulsion device of the type suitable for use on watercraft such as small boats and canoes.

The resulting invention provides a user the capability of conveniently mounting the instant invention between the gunwales of a canoe to provide propulsion thereto while deriving pleasure and the benefits of physical exercise during use.

The above and the other objects are achieved in accordance with the present invention, which, according to a first aspect, provides a pedal driven propulsion device comprising a stand having a base, a housing, a first post, disposed between the base and fixedly attached to the housing, a second post slideably extending within the first post for adjusting the base. A drive assembly, supported by the stand, having a drive rod disposed within a tubular drive shaft and the drive rod driven by a chain connected between a first sprocket and a second sprocket and by a pedal and a crank assembly connected to the first sprocket and rotatably cooperating with the chain. A propeller assembly having an upper portion and a lower portion, a tubular propeller shaft having a propeller drive rod therein and the tubular propeller shaft disposed between the upper and lower portions, and the propeller drive rod coupled to and drivably engaged with the drive rod of the drive assembly at the upper portion and to a propeller rotatively disposed at the lower portion, for providing propulsion to a watercraft when the drive assembly is activated. A steering assembly having a handle and a link pivotably connected to the handle and to a bracket on the propeller assembly for cooperating with the propeller assembly and with the drive assembly. A mounting assembly, for adjustably and removably mounting to the gunwales of the watercraft, having a first rail, a second rail parallel to and in a spaced relationship to the first rail and means for clamping.

The second aspect is a special case of the first aspect of this invention with additional features. According to a second aspect of the invention, a pedal driven propulsion device is provided with the lower portion and the upper portion of the propeller assembly having a bevel gear system with a bearing arrangement. The portions are cooperatively and driveably engaged with each other by the propeller drive rod. The lower portion has a watertight sealing arrangement. A tilting mechanism is provided to allow the propeller assembly to be tilted.

According to a third aspect of the invention, a portable, gunwale mountable, pedal driven propulsion device for a canoe is disclosed. The third aspect is a special case of the first and second aspects of this invention with additional features. The upper portion and the lower portion of the propeller assembly are removably joined and the propeller drive rod is removably detachable from a third bevel gear of the bevel gear system. The upper portion further has a first means for retaining the upper portion and the lower portion when the portions are removably joined. The first means retainably supports a fourth bearing and the third bevel gear when the propeller drive rod is removed from the third bevel gear when the upper portion and the lower portion are separated. The upper portion further has a second means for retaining the upper portion and the lower portion in relative close proximity to each other during disassembly and separation to prevent loss of the portions during transporting and storage of the propulsion device.

DETAILED DESCRIPTION OF PREFERRED EMBODIMENTS

Figure 1:
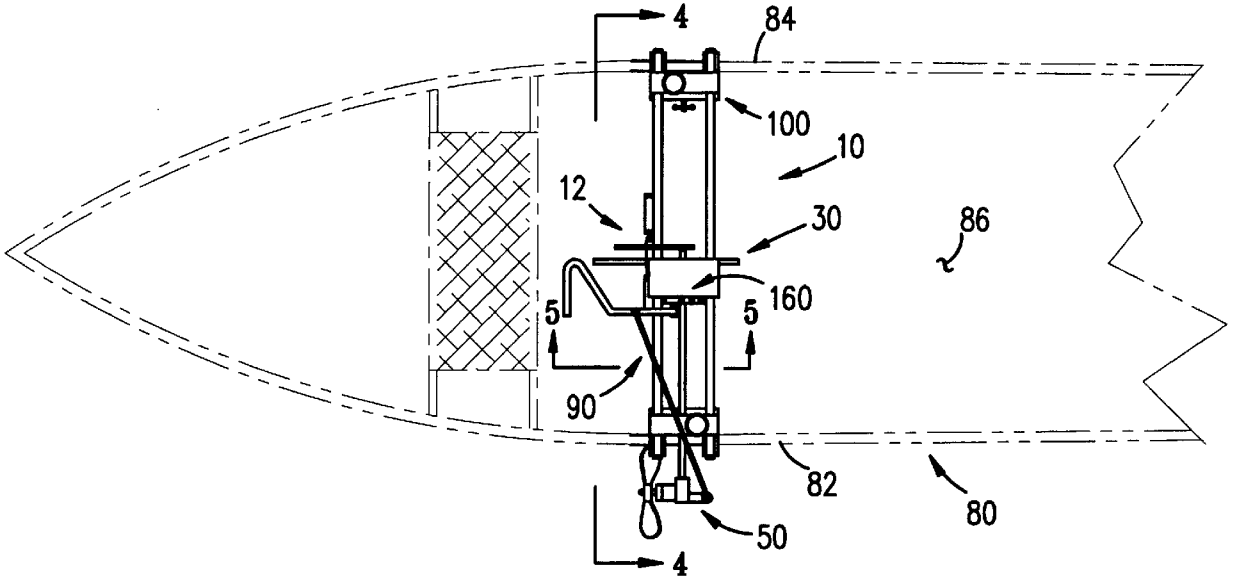
FIG. 1 is a top plan view of a preferred embodiment of a pedal driven propulsion device of the instant invention mounted between the gunwales of a watercraft such as a canoe and illustrating the main components of the device.

Looking more particularly to the drawings of FIGS. 1 to 8, FIG. 1 depicts a top plan view of a preferred embodiment of a pedal driven propulsion device, indicated generally at 10, of the instant invention mounted between the gunwales of a watercraft and illustrating the main components and assemblies of the device 10. The watercraft, as discussed herein, is understood to be a small boat, a skiff, a raft, a canoe or other type of marine apparatus having gunwales or suitable surfaces for mounting the device 10 thereto. The pedal driven propulsion device 10, essentially comprises a stand 30, a drive assembly 12 supported by the stand 30, a propeller assembly 50 coupled to the drive assembly 12, a steering assembly 90 cooperating with the propeller assembly 50 and with the drive assembly 12, a mounting assembly 100 for mounting between the gunwales 82,84 of the watercraft such as a canoe 80. The propeller assembly 50 is disposed outboard and oriented adjacent to the gunwales 82,84 of the canoe 80 in a spaced relationship thereto.

Although not necessary for operation, preferably, a tilting mechanism 160 for tilting the propeller assembly 50 is provided to make the invention more useful during operation.

Figure 2:
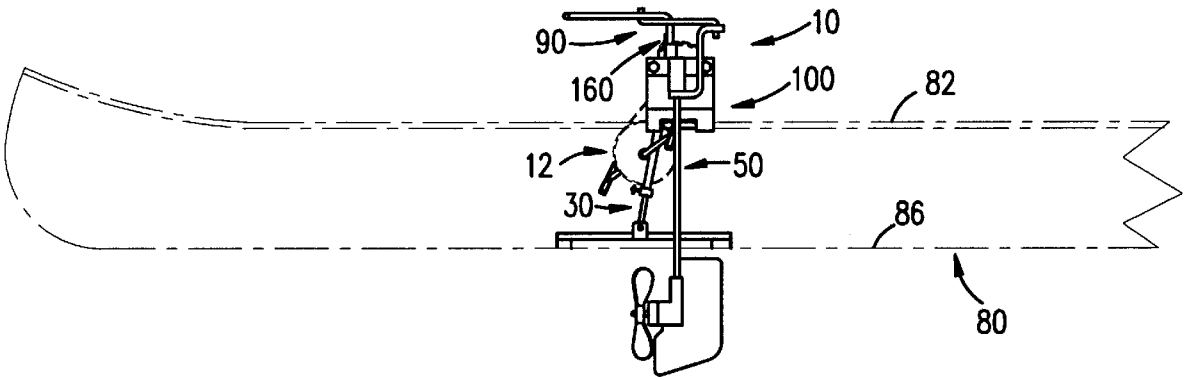
FIG. 2 is a side elevation view of a preferred embodiment of the device of FIG. 1.

As shown in FIG. 2, which is a side elevation view of a preferred embodiment of the pedal driven propulsion device 10 of FIG. 1, the stand 30 rests on a floor 86 of the canoe 80 and may be adjusted, as needed, to accommodate various watercraft.

Additional design details of the pedal driven propulsion device 10 are best understood by turning to the accompanying drawings, FIGS. 3 to 8.

Figure 3:
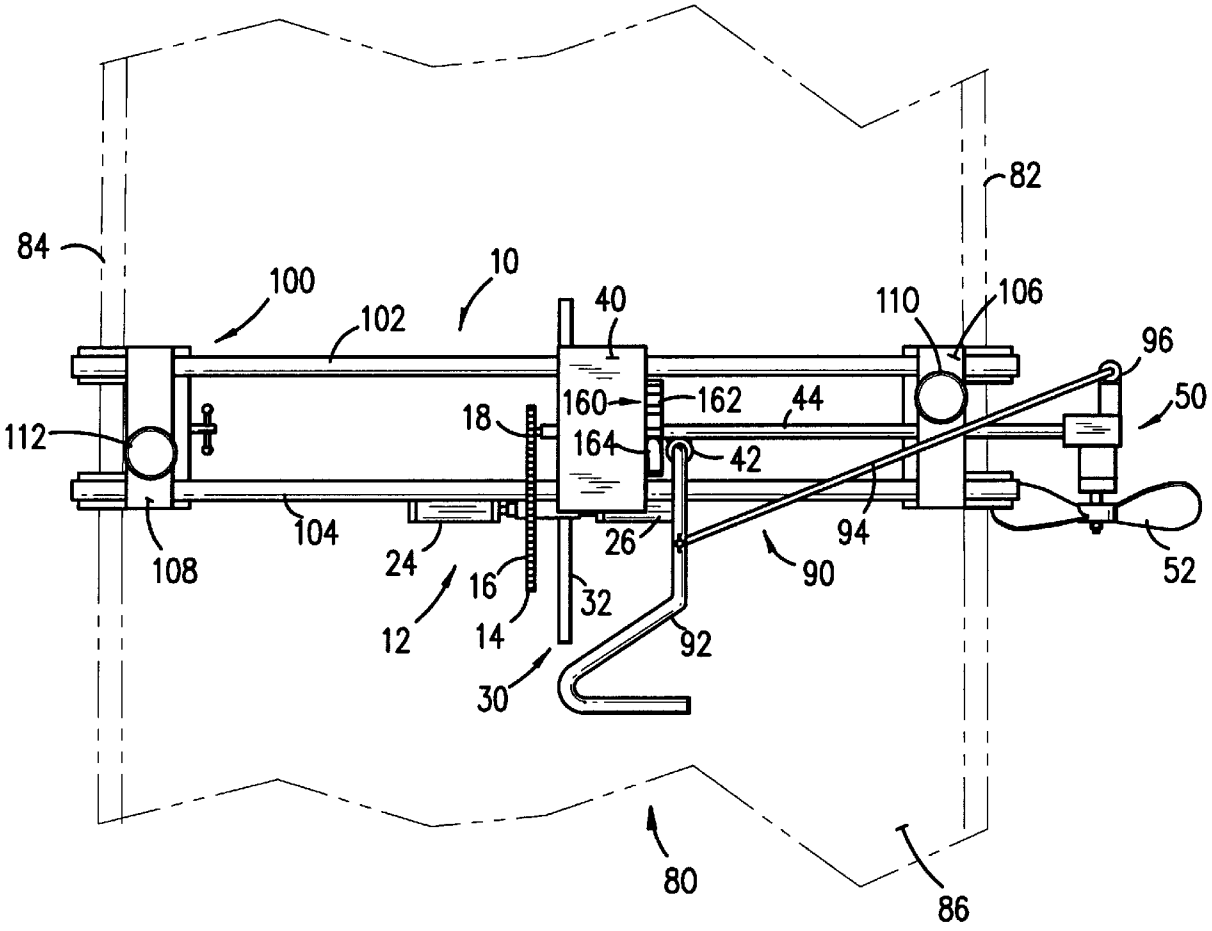
FIG. 3 is an enlarged top plan view of the pedal driven propulsion device of FIG. 1.

FIG. 3 is an enlarged top plan view of the pedal driven propulsion device 10 of FIG. 1. Drive assembly 12 has a drive rod 46 (shown in FIGS. 4,5, 7 and 8) disposed within a tubular drive shaft 44. Drive rod 46 is driven by a chain 14 connected between a first sprocket 16 and a second sprocket 18. A pedal 24,26 and a crank 20,22 assembly (shown in FIGS. 3,4 and 5) is connected to the first sprocket 16 and rotatably cooperating with the chain 14 when activated by a human. A collar 28 supports the pedal 24,26 and the crank 20,22 assembly. The stand 30, which supports drive assembly 12, shown best in FIG. 5, has a base 32 which rests on the floor 86 of the canoe 80, a housing 40, a first post 34 disposed between the base 32 and fixedly attached to the housing 40, and a second post 36 which slideably extends within the first post 34 for adjusting the base 32 with respect to the floor 86. The propeller assembly 50 has an upper portion 120 and a lower portion 58, a tubular propeller shaft 54 having a propeller drive rod 56 therein and the tubular propeller shaft 54 disposed between the upper and lower portions, 120,58 respectively, and the propeller drive rod 56 coupled to and drivably engaged with the drive rod 46 of the drive assembly 12 at the upper portion 120 and to a propeller 52 rotatively disposed at the lower portion 58, for providing propulsion to the canoe 80 when the drive assembly 12 is activated. The steering assembly 90 is provided for steering and has a handle 92 disposed in a boss 42 which is fixed to a tubular drive shaft 44 and a link 94 pivotably connected to the handle 92 and to a bracket 96 on the propeller assembly 50 for cooperating with the propeller assembly 50 and with the drive assembly 12.

The mounting assembly 100, for adjustably and removably mounting to the gunwales 82,84 of the watercraft such as the canoe 80, has a first rail 102, a second rail 104 parallel to and in a spaced relationship to the first rail 102 and a means for clamping. The clamping means comprises a first clamp 106 having a knob 110 and a vice portion 116. The first clamp 106 is slidably and adjustably moved along the first rail 102, the second rail 104 and a second clamp 108 having a knob 112 and a vice portion 114 is slideably moved along the rails 102,104 and the tubular drive shaft 44 until the first clamp 106 and the second clamp 108 are in close proximity to the gunwales 82,84 of the canoe 80. This is accomplished by loosening each knob 110,112 to permit the sliding motion needed for adjustment of the mounting assembly 100 to fit on a particular canoe 80 and the knobs 110,112 are later tightened to retain the clamps 106,108 in place. The vice portions 114,116 are placed over the gunwales 82,84 and are tightened to securely hold the mounting assembly 100 in place. The housing 40 being disposed therebetween the first and the second clamps 106,108. The first and second rails 102,104 extending longitudinally through the housing 40 and the tubular drive shaft 44 disposed parallel to and midway between the first and said second rails 102,104. The tubular drive shaft 44 extending from the housing 40 to the propeller assembly 50.

Figure 4:
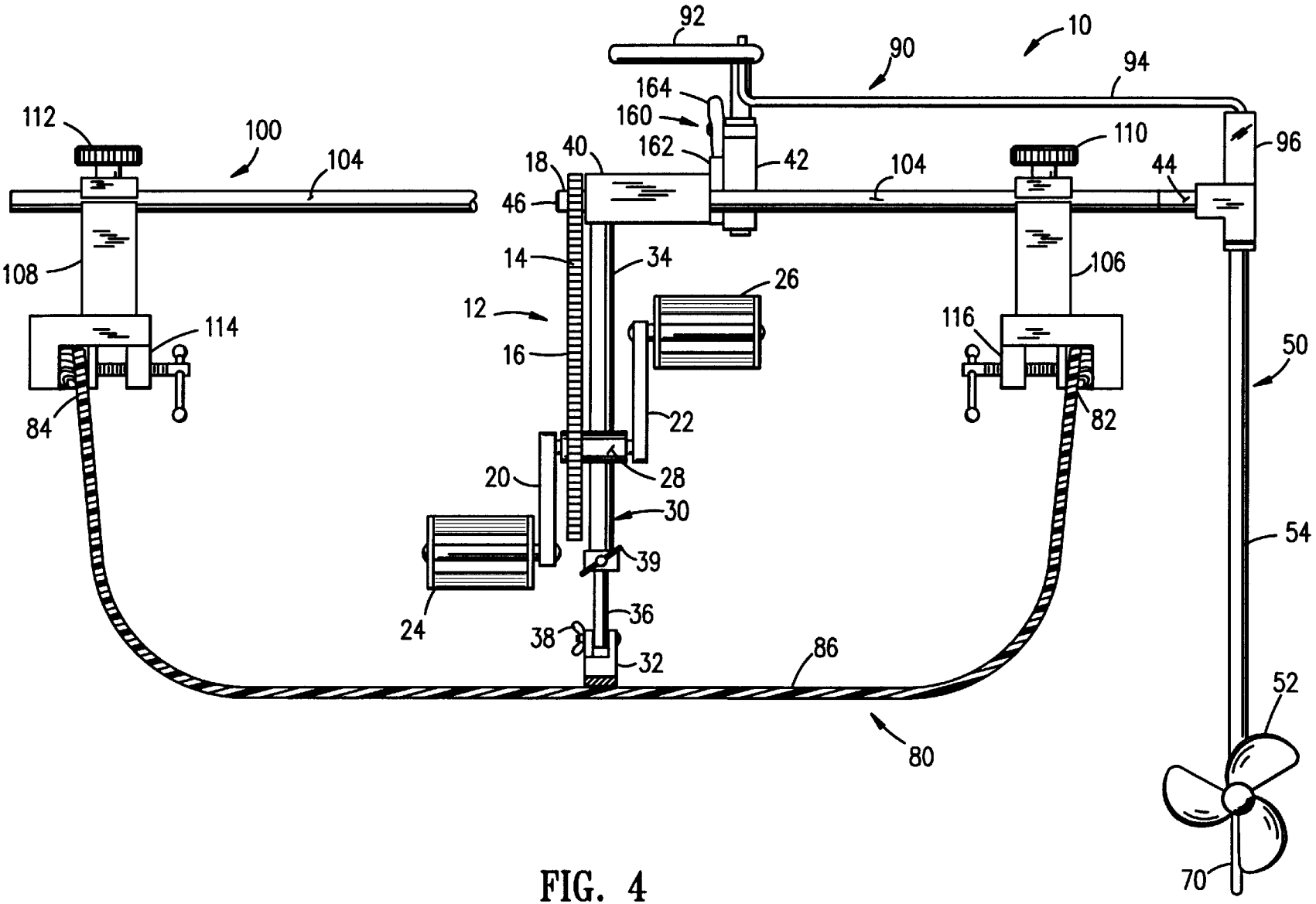
FIG. 4 is an enlarged partial sectional view of the pedal driven propulsion device of FIG. 1 along the line 4—4.

FIG. 4 is an enlarged partial sectional view of the pedal driven propulsion device 10 of FIG. 1 along the line 4—4.

Figure 5:
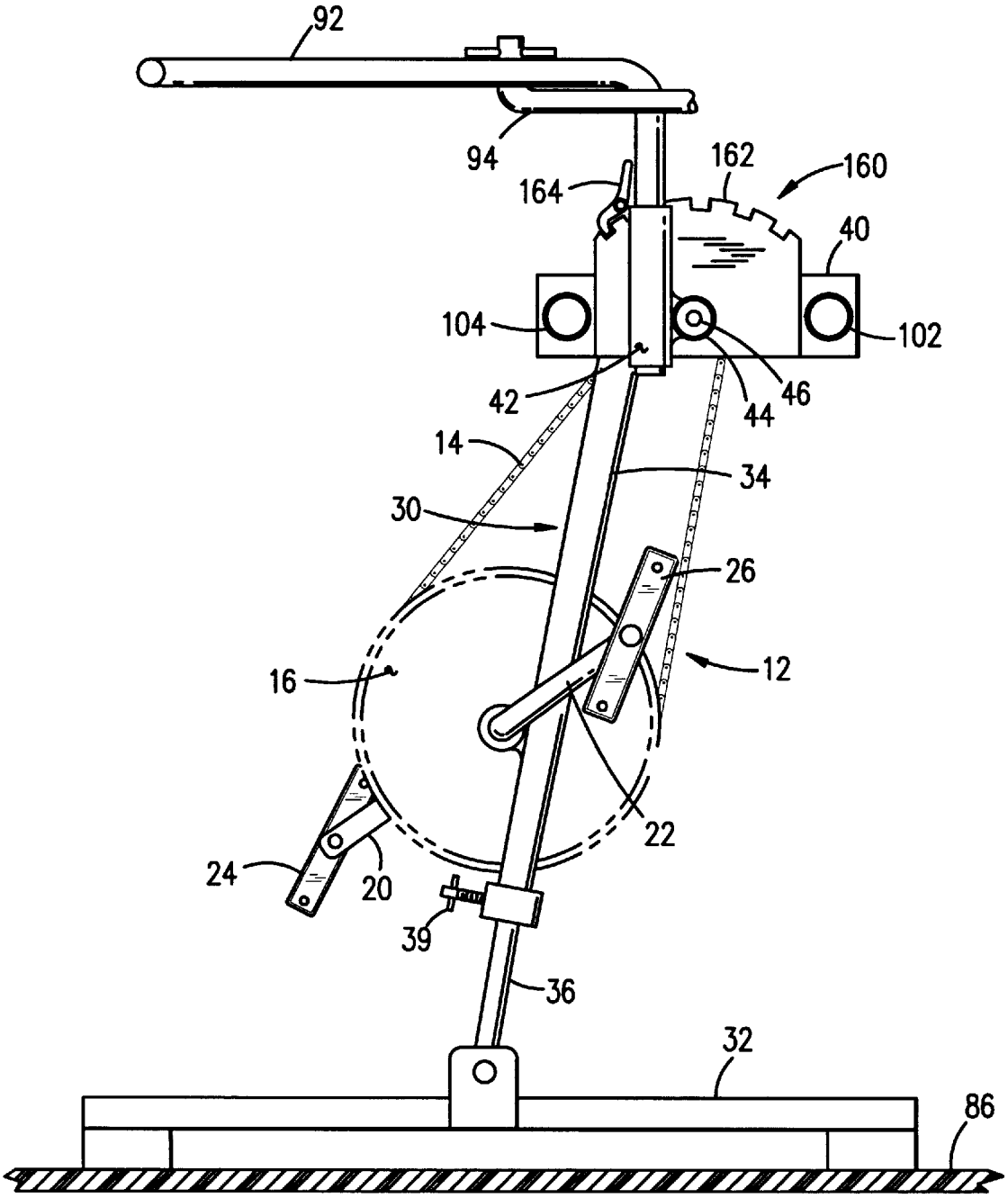
FIG. 5 is a partial sectional view of the pedal driven propulsion device of FIG. 1 along the line 5—5 showing a drive assembly.

FIG. 5 is a partial sectional view of the pedal driven propulsion device 10 of FIG. 1 along the line 5—5 showing the drive assembly 12, the stand 30 and the tilting mechanism 160 which allows the propeller assembly 50 to be tilted. The tilting mechanism 160 has a notched member 162 attached to the housing 40 and an indexing member 164, attached to the boss 42, cooperating with the notched member 162. When needed, the indexing member 164, being spring loaded, is activated for repositioning in the notched member 162 during tilting. The propeller assembly 50 is rotatively responsive to the steering assembly 90, about a longitudinal axis of the tubular drive shaft 44, when the propeller assembly 50 is tilted.

Figure 6:
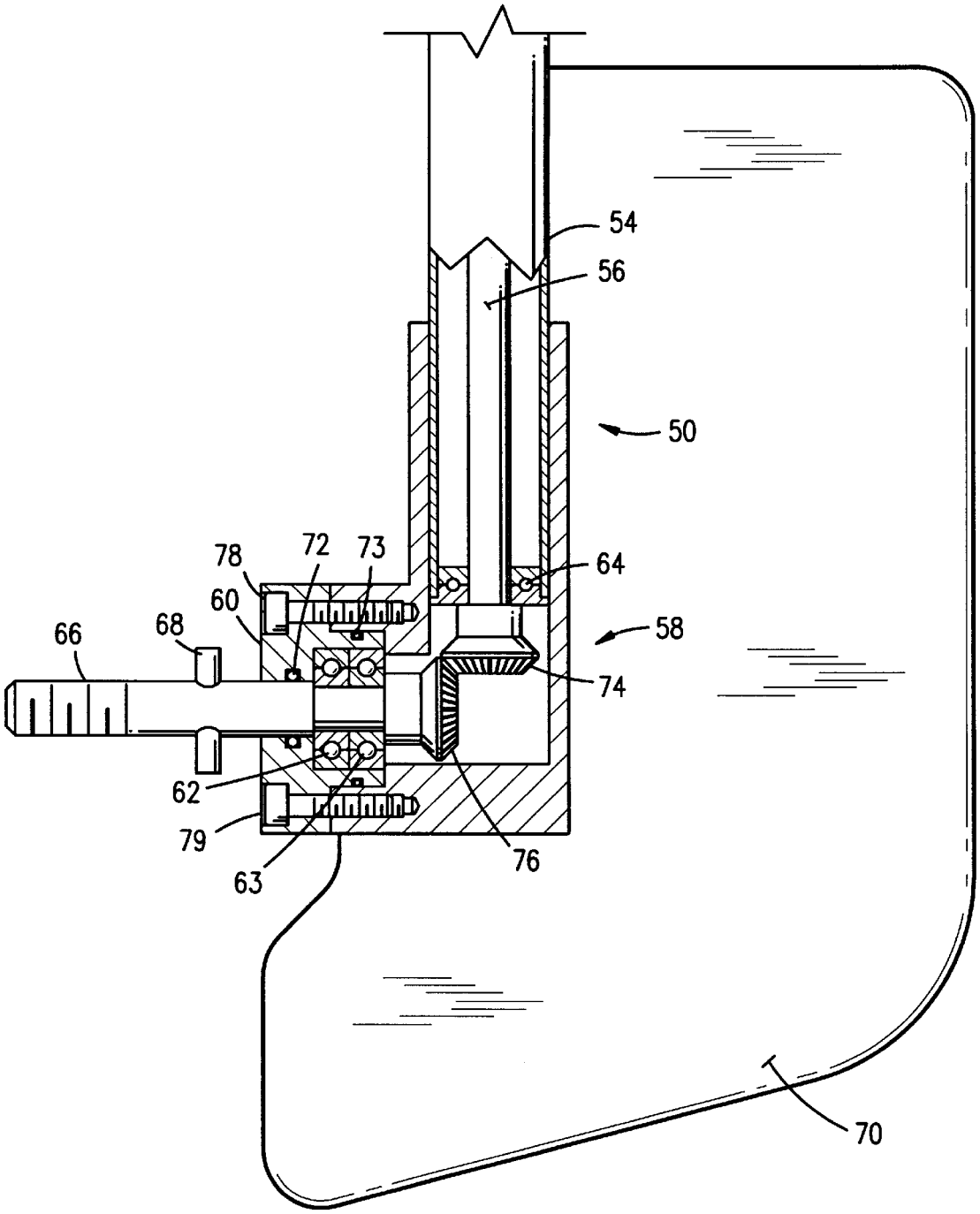
FIG. 6 is a partial sectional view of a propeller assembly of the pedal driven propulsion device showing a lower portion.

FIG. 6 is a partial sectional view of the propeller assembly 50 of the pedal driven propulsion device 10 showing the lower portion 58. The lower portion 58 of the propeller assembly 50 comprises a first bevel gear 74 attached to an end of the propeller drive rod 56 drivably engaged with a second bevel gear 76 attached to an end of a threaded propeller shaft 66. A third bearing 64 is disposed on the propeller drive rod 56 adjacent the first bevel gear 74. The propeller 52 (shown in FIGS. 1 to 4) is rotatively disposed on a free end of the threaded propeller shaft 66 and secured with a shear pin 68 that protects the propeller assembly 50 from damage should the propeller 52 contact an underwater obstruction. A first bearing 62 is disposed adjacent to a second bearing 63 and each first and second bearings 62,63 linearly are disposed on the threaded propeller shaft 66. A first seal 72 is disposed on the threaded propeller shaft 66 in a cap 60 and a second seal 73 is disposed in a portion of the cap 60 midway between the first bearing 62 and the second bearing 63. A fastener 78 is used for attaching the cap 60 and a skeg 70 for improved navigation, preferably, is attached to the lower portion 58. Being portable, the pedal driven propulsion device 10 may be readily partially disassembled for ease of transporting and for storage. This is accomplished in a novel manner and best understood by turning to FIGS. 7 and 8.

Figure 8:
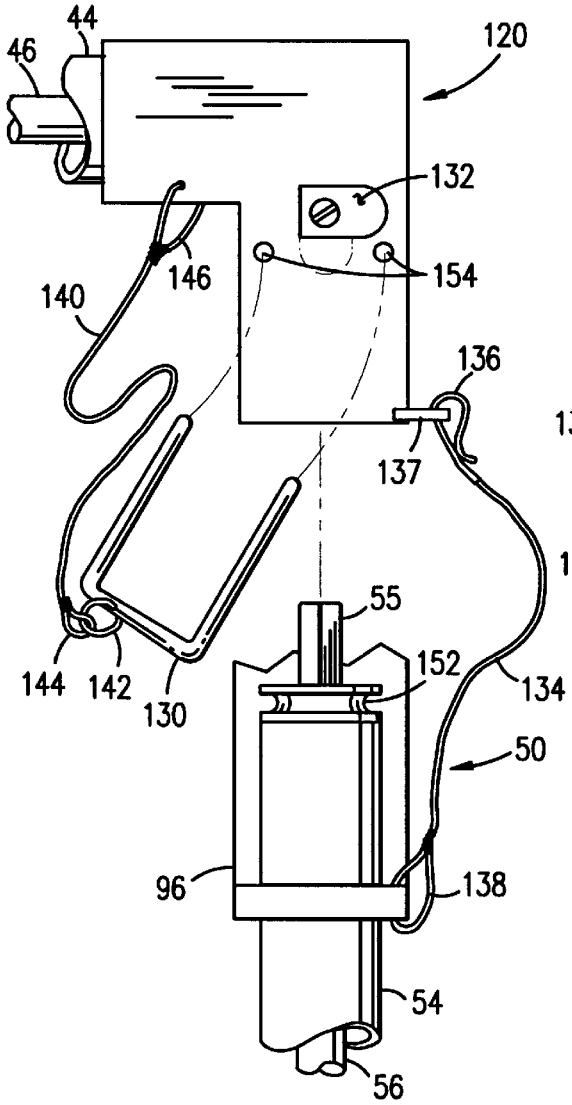
Figure 7:
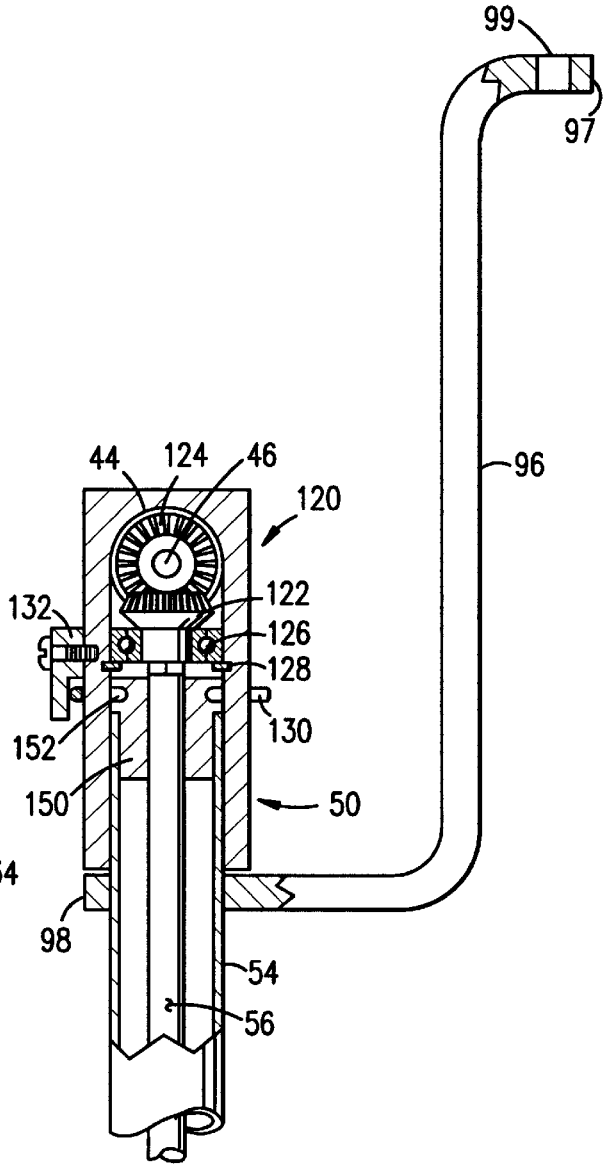
FIG. 7 is a partial side sectional view of the propeller assembly of the pedal driven propulsion device showing an upper portion and a first retaining means and, FIG. 8 is a partial front sectional view showing further details of the first retaining means of FIG. 7 and a second retaining means for the propeller assembly of the pedal driven propulsion device.

FIG. 7 is a partial side sectional view of the propeller assembly 50 of the pedal driven propulsion device 10 showing the upper portion 120 and a first retaining means and FIG. 8 is a partial front sectional view showing further details of the first retaining means of FIG. 7 and a second retaining means for the propeller assembly 50 of the pedal driven propulsion device 10.

The upper portion 120 of the propeller assembly 50 includes a third bevel gear 122 attached to an end of the propeller drive rod 56 and a fourth bearing 126 disposed on the propeller drive rod 56 adjacent the third bevel gear 122 and the third bevel gear 122 cooperating with and drivably connected to a fourth bevel gear 124 disposed at an end of the drive rod 46.

The upper portion 120 and the lower portion 58 of the propeller assembly 50 are removably joined. The propeller drive rod 56 has a square end 55 removably coupled to a square bore (not shown) disposed within the third bevel gear 122. The upper portion 120 further comprising first means for retaining the upper portion 120 and the lower portion 58 when the upper portion 120 and the lower portion 58 are removably joined. The first retaining means comprises a "U" pin 130 slideably disposed in the upper portion 120 through an aperture 154 therein, a bushing 150, disposed on the propeller drive rod 56, having a groove 152 thereon to receive the "U" pin 130 and a one quarter turn fastener 132 disposed on the upper portion 120 that releasably locks the "U" pin 130 and keeps the upper portion 120 removably joined to the lower portion 58. The first retaining means further comprises a retaining ring 128 for retainably supporting the fourth bearing 126 and the third bevel gear 122 when the propeller drive rod 56 is removed from the third bevel gear 122 when the upper portion 120 and the lower portion 58 are separated. The upper portion 120 further comprising second means for retaining the upper portion 120 and the lower portion 58 in relative close proximity to each other during disassembly and separation to prevent loss of the portions during transporting and storage of the propulsion device 10. The second retaining means comprises a first tether 134 having a hook 136 at one end and a first loop 138 at the other end and the first loop 138 attached to the bracket 96 and the hook 136 removably attached to a first ring 137 on the upper portion 120. The second retaining means further comprises a second tether 140 having a second ring 142 attached to the "U" pin 130 and a second loop 144 attached to the second ring 142 and a third loop 146 attached to the upper portion 120 to prevent loss of the "U" pin. 130.

The pedal driven propulsion device 10, preferably may be fabricated by conventional metal fabrication techniques such as by metal forming and uses readily available components and materials for construction. Corrosion resistant materials such as, but not limited to, brass, steel and aluminum may be used. Although not necessary for operation, the pedal driven propulsion device 10 may have an electro plate finish, a corrosion resistant coating such as an epoxy based paint or the like for particular consumer applications. Alternately, the pedal driven propulsion device 10 may also be adapted for manufacture utilizing other durable nonmetals such as plastic and rubber may be selectively used for suitable components such as, but not limited to, the propeller 52 and for the first seal 72 and for the second seal 73. Also, it is understood that nonmetal materials such as plastic or combinations of metal and plastic, metal and rubber and metal, plastic and rubber may be used as required. Although the pedal driven propulsion device 10 is designed and suitably sized to fit between the gunwales of the canoe 80, for example, it is understood that the pedal driven propulsion device 10 may be constructed in, and adapted to, various sizes and style variations for use with a particular application without departing from the scope of this disclosure.

Installation and operation of the pedal driven propulsion device 10, is best understood by turning to FIGS. 1 to 5.

The pedal driven propulsion device 10, is installed between the gunwales 82,84 of a watercraft such as the canoe 80 with the mounting assembly 100 and the clamping means discussed above.

The stand 30 may be adjusted so that the base 32 rests on the floor 86 of the canoe 80. This is done by loosening a second wing nut fastener 39 on the first post 34 to allow the second post 36 to move until the base 32 contacts the floor 86 of the canoe 80. A first wing nut fastener 38 on the second post 36 is removably attached to the base 32 for further adjustment and to facilitate transporting of the pedal driven propulsion device 10, as needed.

Operation is very straight forward. With the pedal driven propulsion device 10 installed on the canoe 80, and when the canoe 80 is launched in a body of water, a human simply pedals the drive assembly 12 which thereby causes the propeller 52 of the propeller assembly 50 to rotate and to provide propulsion. The drive to driven ratio of the first sprocket 16 (drive) to the second sprocket 18 (driven) of the drive assembly 12 is in the range of about 4:1 to 8:1 thereby making the propulsion device 10 easy and relatively effortless to operate.

Steering is accomplished by use of the steering assembly 90 which has a handle 92 and a link 94 pivotably connected to the handle 92 and to a bracket 96 on the propeller assembly 50 for cooperating with the propeller assembly 50 and with the drive assembly 12. The handle 92 is disposed in the boss 42 which is fixed to the tubular drive shaft 44. The link 94 is removably and freely fitted to a first end 97 of the bracket 96 having an opening 99 therein. A second end 98 of the bracket 96 is fixed to the tubular propeller shaft 54. The tubular propeller shaft 54 is pivotably responsive to the steering assembly 12, about a longitudinal axis of the tubular propeller shaft 54, for orienting the propeller 52 during a steering operation.

The tilting mechanism 160 discussed above allows the propeller assembly 50 to be tilted.

The pedal driven propulsion device 10 may be readily partially disassembled for ease of transporting and for storage as previously discussed. Essentially, the one quarter turn fastener 132 is moved 90 degrees in a counter clockwise direction allowing the "U" pin 130 to be removed, and, to prevent loss, the second tether 140 retains the "U" pin 130. The upper portion 120 and the lower portion 58 of the propeller assembly 50 are now allowed to freely separate when the propeller drive rod 56 is removed from the third bevel gear 122. The retaining ring 128 retainably supports the fourth bearing 126 and the third bevel gear 122 when the propeller drive rod 56 is removed from the third bevel gear 122. The first tether 134 retains the upper portion 120 and the lower portion 58 in relative close proximity to each other during disassembly and separation to prevent loss of the portions during transporting and storage of the propulsion device 10. The tether 134 may be sized to provide adequate length to facilitate transporting of the device 10. Also, the hook 136 may be removed from the first ring 137, as needed, for convenience.

One practical advantage of the invention is that it provides an efficient, convenient, practical, low cost and versatile portable pedal driven propulsion device 10 that fits practically any watercraft.

Another advantage of the invention is that the pedal driven propulsion device 10 is designed for ease of manufacture and for portability as well as for functionality, particularly with the disassembly feature utilizing the "U" pin. 130, the first tether 134 and the second tether 140 together with the adjustment capability via the mounting assembly 100 as well as the other features previously mentioned herein.

A further advantage of the instant invention is that since it is human powered, it provides economical non-polluting ecological operation.

Still a further advantage is that the pedal driven propulsion device 10 provides a fun and convenient means for exercising the human body while pursuing other healthful and enjoyable activities such as boating and fishing.

The instant invention provides a pedal driven propulsion device 10 that can be readily used on a watercraft such as a small boat or on the canoe 80 to provide propulsion thereto and to provide exercise for the human user. In lieu of marine applications, the instant invention may be adapted for use where a mixing, a stirring, an agitating or a blending type of operation is needed. In such a case, the device 10 may be employed by placing the propeller assembly 50 into a container having ingredients in need of processing and the stand 30 may be remotely mounted and the drive assembly 12 operated by a human as needed. Of course, other advantages and benefits of the present invention will become apparent to one skilled in the art.

As disclosed, it is apparent that the instant invention can provide options for use on various structures and for other types of applications. One skilled in the art will realize that the foregoing discussion outlines the more important features of the invention to enable a better understanding of the instant invention and to instill a better appreciation of the inventor's contribution to the art. It must be clear that the disclosed details of construction, descriptions of geometry and illustrations of inventive concepts are mere examples of possible manifestations of the invention.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A pedal driven propulsion device comprising:

a stand having a base, a housing, a first post disposed between said base and fixedly attached to said housing and a second post slideably extending within said first post for adjusting said base;

a drive assembly, supported by said stand, having a drive rod disposed within a tubular drive shaft and said drive rod driven by a chain connected between a first sprocket and a second sprocket and by a pedal and a crank assembly connected to said first sprocket and rotatably cooperating with said chain;

a propeller assembly having an upper portion and a lower portion, a tubular propeller shaft having a propeller drive rod therein and said tubular propeller shaft disposed between said upper portion and between said lower portion and said propeller drive rod coupled to and drivably engaged with said drive rod of said drive assembly at said upper portion and to a propeller rotatively disposed at said lower portion for providing propulsion to a watercraft when said drive assembly is activated wherein said propeller assembly is disposed outboard and oriented adjacent to the gunwales of the watercraft in a spaced relationship thereto;

a steering assembly having a handle and a link pivotably connected to said handle and to a bracket on said propeller assembly for cooperating with said propeller assembly and with said drive assembly; and a mounting assembly, for adjustably and removably mounting between the gunwales of the watercraft, having a first rail, a second rail parallel to and in a spaced relationship to said first rail and a first clamp and a second clamp each slidably attached to both said first rail and to said second rail and said first clamp also slidably attached to said tubular drive shaft with said housing disposed therebetween said first clamp and said second clamp and said first rail and said second rail extending longitudinally through said housing and said tubular drive shaft disposed parallel to and midway between said first rail and said second rail and said tubular drive shaft extending from said housing to said propeller assembly and said first clamp and said second clamp each having a knob for slideably moving and for securing said first clamp and said second clamp in a fixed position and a vice portion for attachment to the gunwales of the watercraft.

2. The propulsion device of claim 1 wherein said lower portion of said propeller assembly comprises a first bevel gear attached to an end of said propeller drive rod and drivably engaged with a second bevel gear attached to an end of a threaded propeller shaft, a third bearing disposed on said propeller rod adjacent said first bevel gear, said propeller rotatively disposed on a free end of said threaded propeller shaft, a first bearing disposed adjacent to a second bearing and each said first and said second bearing linearly disposed on said threaded propeller shaft.

3. The propulsion device of claim 2 wherein said lower portion of said propeller assembly further comprises a first seal disposed on said threaded propeller shaft in a cap and a second seal disposed in a portion of said cap midway between said first bearing and said second bearing and a fastener for attaching said cap.

4. The propulsion device of claim 3 wherein said lower portion of said propeller assembly further comprises a skeg attached to said lower portion.

5. The propulsion device of claim 4 wherein said upper portion of said propeller assembly includes a third bevel gear attached to an end of said propeller drive rod and a fourth bearing disposed on said propeller drive rod adjacent said third bevel gear and said third bevel gear cooperating with and drivably connected to a fourth bevel gear disposed at an end of said drive rod.

6. The propulsion device of claim 5 further comprising a boss fixed to said tubular drive shaft wherein an end of said handle is movably disposed in said boss.

7. The propulsion device of claim 6 wherein said link of said steering assembly is pivotably attached to said handle and removably fitted to a first end of said bracket having an opening therein of said propeller assembly and a second end of said bracket fixed to said tubular propeller shaft.

8. The propulsion device of claim 7 wherein said tubular propeller shaft is pivotably responsive to said steering assembly, about a longitudinal axis of said tubular propeller shaft, for orienting said propeller during a steering operation.

9. The propulsion device of claim 8 further comprising a tilting mechanism having a notched member attached to said housing and an indexing member attached to said boss cooperating with said notched member wherein said propeller assembly is rotatively responsive to said steering assembly, about a longitudinal axis of said tubular drive shaft, when said propeller assembly is tilted.

10. The propulsion device of claim 9 wherein said upper portion and said lower portion of said propeller assembly are removably joined.

11. The propulsion device of claim 10 wherein said propeller drive rod has a square end removably coupled to a square bore disposed within said third bevel gear.

12. The propulsion device of claim 11 wherein said upper portion further comprising first means for retaining said upper portion and said lower portion when said upper portion and said lower portion are removably joined.

13. The propulsion device of claim 12 wherein said first retaining means comprises a "U" pin slideably disposed in said upper portion through an aperture therein, a bushing, disposed on said propeller drive rod, having a groove thereon to receive said "U" pin and a one quarter turn fastener disposed on said upper portion that releasably locks said "U" pin and keeps said upper portion removably joined to said lower portion.

14. The propulsion device of claim 13 wherein said first retaining means further comprises a retaining ring for retainably supporting said fourth bearing and said third bevel gear when said propeller drive rod is removed from said third bevel gear when said upper portion and said lower portion are separated.

15. The propulsion device of claim 14 wherein said upper portion further comprising second means for retaining said upper portion and said lower portion in relative close proximity to each other during disassembly and separation to prevent loss of said portions during transporting and storage of said propulsion device.

16. The propulsion device of claim 15 wherein said second retaining means comprises a first tether having a hook at one end and a first loop at the other end and said first loop attached to said bracket and said hook removably attached to a first ring on said upper portion.

17. The propulsion device of claim 16 wherein said second retaining means further comprises a second tether having a second ring attached to said "U" pin and a second loop attached to said second ring and a third loop attached to said upper portion to prevent loss of said "U" pin.

18. The propulsion device of claim 17 wherein said propulsion device is constructed from corrosion resistant materials.

19. The propulsion device of claim 18 wherein said propulsion device is portable and is readily disassembled for transporting and storage.

20. The propulsion device of claim 19 wherein said propulsion device is removably and adjustably mountable between the gunwales of a canoe.

21. The propulsion device of claim 20 wherein said propulsion device is propelled by a human.

22. The propulsion device of claim 21 wherein the drive to driven ratio of said first sprocket to second sprocket of said drive assembly is in the range of about 4:1 to 8:1.

23. A pedal driven propulsion device comprising:

a stand having a base, a housing, a first post disposed between said base and fixedly attached to said housing and a second post slideably extending within said first post for adjusting said base;

a drive assembly, supported by said stand, having a drive rod disposed within a tubular drive shaft and said drive rod driven by a chain connected between a first sprocket and a second sprocket and by a pedal and a crank assembly connected to said first sprocket and rotatably cooperating with said chain;

a propeller assembly having an upper portion and a lower portion, a tubular propeller shaft having a propeller drive rod therein and said tubular propeller shaft disposed between said upper portion and between said lower portion and said propeller drive rod coupled to and drivably engaged with said drive rod of said drive assembly at said upper portion and to a propeller rotatively disposed at said lower portion for providing propulsion to a watercraft when said drive assembly is activated wherein said propeller assembly is disposed outboard and oriented adjacent to the gunwales of the watercraft in a spaced relationship thereto;

said lower portion of said propeller assembly having a first bevel gear attached to an end of said propeller drive rod and drivably engaged with a second bevel gear attached to an end of a threaded propeller shaft, a third bearing disposed on said propeller rod adjacent said first bevel gear, said propeller rotatively disposed on a free end of said threaded propeller shaft, a first bearing disposed adjacent to a second bearing and each said first and said second bearing linearly disposed on said threaded propeller shaft, a first seal disposed on said threaded propeller shaft in a cap and a second seal disposed in a portion of said cap midway between said first bearing and said second bearing, a fastener for attaching said cap and a skeg attached to said lower portion;

said upper portion of said propeller assembly having a third bevel gear attached to an end of said propeller drive rod and a fourth bearing disposed on said propeller drive rod adjacent said third bevel gear and said third bevel gear cooperating with and drivably connected to a fourth bevel gear disposed at an end of said drive rod;

a steering assembly having a handle and a link pivotably connected to said handle and to a bracket on said propeller assembly for cooperating with said propeller assembly and with said drive assembly;

a boss fixed to said tubular drive shaft wherein an end of said handle is movably disposed in said boss and said link of said steering assembly is pivotably attached to said handle and removably fitted to a first end of said bracket having an opening therein of said propeller assembly and a second end of said bracket fixed to said tubular propeller shaft;

a tilting mechanism having a notched member attached to said housing and an indexing member attached to said boss cooperating with said notched member wherein said propeller assembly is rotatively responsive to said steering assembly, about a longitudinal axis of said tubular drive shaft, when said propeller assembly is tilted; and a mounting assembly, for adjustably and removably mounting between the gunwales of the watercraft, having a first rail, a second rail parallel to and in a spaced relationship to said first rail and means for clamping.

24. The propulsion device of claim 23 wherein said upper portion and said lower portion of said propeller assembly are removably joined and said upper portion having first means for retaining said upper portion and said lower portion when said upper portion and said lower portion are removably joined.

25. A pedal driven propulsion device comprising:

a stand having a base, a housing, a first post disposed between said base and fixedly attached to said housing and a second post slideably extending within said first post for adjusting said base;

a drive assembly, supported by said stand, having a drive rod disposed within a tubular drive shaft and said drive rod driven by a chain connected between a first sprocket and a second sprocket and by a pedal and a crank assembly connected to said first sprocket and rotatably cooperating with said chain;

a propeller assembly having an upper portion and a lower portion, a tubular propeller shaft having a propeller drive rod therein and said tubular propeller shaft disposed between said upper portion and between said lower portion and said propeller drive rod coupled to and drivably engaged with said drive rod of said drive assembly at said upper portion and to a propeller rotatively disposed at said lower portion for providing propulsion to a watercraft when said drive assembly is activated wherein said propeller assembly is disposed outboard and oriented adjacent to the gunwales of the watercraft in a spaced relationship thereto;

said upper portion and said lower portion of said propeller assembly are removably joined;

said upper portion having first means for retaining said upper portion and said lower portion when said upper portion and said lower portion are removably joined;

said lower portion of said propeller assembly having a first bevel gear attached to an end of said propeller drive rod and drivably engaged with a second bevel gear attached to an end of a threaded propeller shaft, a third bearing disposed on said propeller rod adjacent said first bevel gear, said propeller rotatively disposed on a free end of said threaded propeller shaft, a first bearing disposed adjacent to a second bearing and each said first and said second bearings linearly disposed on said threaded propeller shaft, a first seal disposed on said threaded propeller shaft in a cap and a second seal disposed in a portion of said cap midway between said first bearing and said second bearing, a fastener for attaching said cap and a skeg attached to said lower portion;

said upper portion of said propeller assembly having a third bevel gear attached to an end of said propeller drive rod and a fourth bearing disposed on said propeller drive rod adjacent said third bevel gear and said third bevel gear cooperating with and drivably connected to a fourth bevel gear disposed at an end of said drive rod wherein said propeller drive rod has a square end removably coupled to a square bore disposed within said third bevel gear;

a steering assembly having a handle and a link pivotably connected to said handle and to a bracket on said propeller assembly for cooperating with said propeller assembly and with said drive assembly;

a boss fixed to said tubular drive shaft wherein an end of said handle is movably disposed in said boss and said link of said steering assembly is pivotably attached to said handle and removably fitted to a first end of said bracket having an opening therein of said propeller assembly and a second end of said bracket fixed to said tubular propeller shaft;

a tilting mechanism having a notched member attached to said housing and an indexing member an indexing member attached to said boss cooperating with said notched member wherein said propeller assembly is rotatively responsive to said steering assembly, about a longitudinal axis of said tubular drive shaft, when said propeller assembly is tilted; and a mounting assembly, for adjustably and removably mounting between the gunwales of the watercraft, having a first rail, a second rail parallel to and in a spaced relationship to said first rail and a first clamp and a second clamp each slidably attached to both said first rail and to said second rail and said first clamp also slidably attached to said tubular drive shaft with said housing disposed therebetween said first clamp and said second clamp and said first rail and said second rail extending longitudinally through said housing and said tubular drive shaft disposed parallel to and midway between said first rail and said second rail and said tubular drive shaft extending from said housing to said propeller assembly and said first clamp and said second clamp each having a knob for slideably moving and for securing said first clamp and said second clamp in a fixed position and a vice portion for attachment to the gunwales of the watercraft.

26. The propulsion device of claim 25 wherein said first retaining means comprises a "U" pin slideably disposed in said upper portion through an aperture therein, a bushing, disposed on said propeller drive rod, having a groove thereon to receive said "U" pin and a one quarter turn fastener disposed on said upper portion that releasably locks said "U" pin and keeps said upper portion removably joined to said lower portion.

27. The propulsion device of claim 26 wherein said first retaining means further comprises a retaining ring for retainably supporting said fourth bearing and said third bevel gear when said propeller drive rod is removed from said third bevel gear when said upper portion and said lower portion are separated.

28. The propulsion device of claim 27 wherein said upper portion further comprising second means for retaining said upper portion and said lower portion in relative close proximity to each other during disassembly and separation to prevent loss of said portions during transporting and storage of said propulsion device.

29. The propulsion device of claim 28 wherein said second retaining means comprises a first tether having a hook at one end and a first loop at the other end and said first loop attached to said bracket and said hook removably attached to a first ring on said upper portion.

30. The propulsion device of claim 29 wherein said second retaining means further comprises a second tether having a second ring attached to said "U" pin and a second loop attached to said second ring and a third loop attached to said upper portion to prevent loss of said "U" pin.

31. The propulsion device of claim 30 wherein said propulsion device is constructed from corrosion resistant materials.

32. The propulsion device of claim 31 wherein said propulsion device is removably and adjustably mountable between the gunwales of a canoe.

33. The propulsion device of claim 32 wherein the drive to driven ratio of said first sprocket to second sprocket of said drive assembly is in the range of about 4:1 to 8:1.

* * * * *